US010620560B2

(12) United States Patent
Uetake et al.

(10) Patent No.: US 10,620,560 B2
(45) Date of Patent: Apr. 14, 2020

(54) ELECTRIFICATION ADJUSTMENT APPARATUS AND IMAGE FORMING APPARATUS

(71) Applicant: Konica Minolta, Inc., Chiyoda-ku, Tokyo (JP)

(72) Inventors: Shigeo Uetake, Higashiyamato (JP); Shigetaka Kurosu, Hino (JP); Atsuto Hirai, Ikoma (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/285,655

(22) Filed: Feb. 26, 2019

(65) Prior Publication Data

US 2019/0294074 A1 Sep. 26, 2019

(30) Foreign Application Priority Data

Mar. 26, 2018 (JP) ..... 2018-057684

(51) Int. Cl.
*G03G 15/02* (2006.01)
*G03G 15/00* (2006.01)

(52) U.S. Cl.
CPC ..... *G03G 15/0291* (2013.01); *G03G 15/80* (2013.01)

(58) Field of Classification Search
CPC . G03G 15/0291; G03G 15/80; B41J 11/0015; B41M 5/20
See application file for complete search history.

(56) References Cited

U.S. PATENT DOCUMENTS

2004/0053174 A1* 3/2004 Fukui ..... G03C 1/49845 430/350
2015/0138266 A1* 5/2015 Chen ..... G06K 15/102 347/14

FOREIGN PATENT DOCUMENTS

JP H0864384 A 3/1996
JP 2002289394 A 10/2002

* cited by examiner

*Primary Examiner* — Lamson D Nguyen
(74) *Attorney, Agent, or Firm* — Buchanan Ingersoll & Rooney PC

(57) ABSTRACT

An electrification adjustment apparatus includes a first electrification adjuster facing the recording material conveyed for supplying charges each with one polarity, and a second electrification adjuster facing the recording material downstream of the first electrification adjuster in a conveying direction for supplying charges each with opposite polarity to that of the charge supplied by the first electrification adjuster. In the electrification adjustment apparatus, an electrostatic capacity between the recording material surface facing the second electrification adjuster, and an electrode partially or entirely formed from the conveyor member is smaller than the one between the recording material surface facing the first electrification adjuster and an electrode partially or entirely formed from the conveyor member. Either front or back surface of the recording material is in contact with the conveyor member in a region between the first and the second electrification adjusters.

8 Claims, 8 Drawing Sheets

FIG. 3
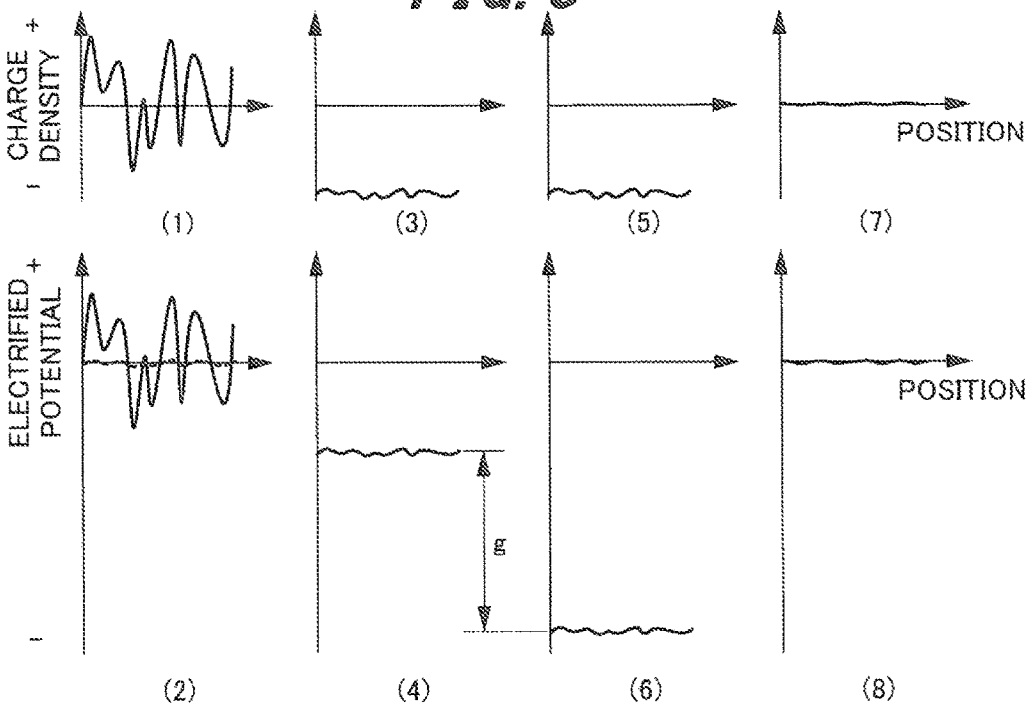
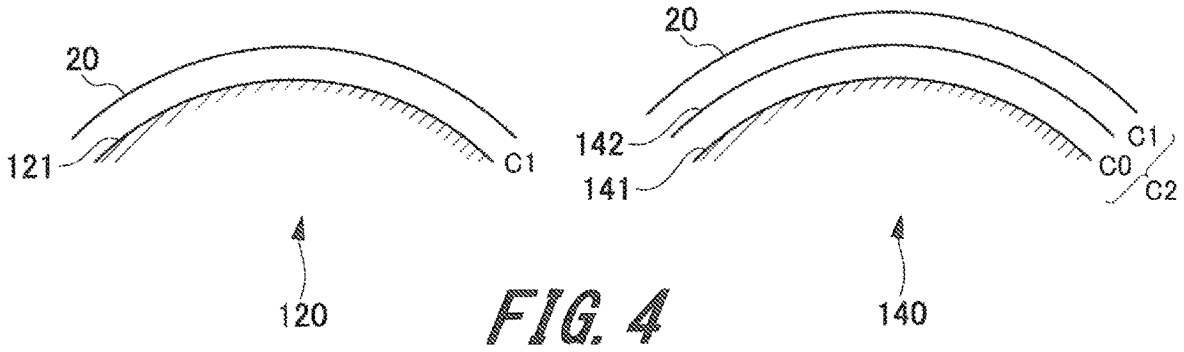
FIG. 4

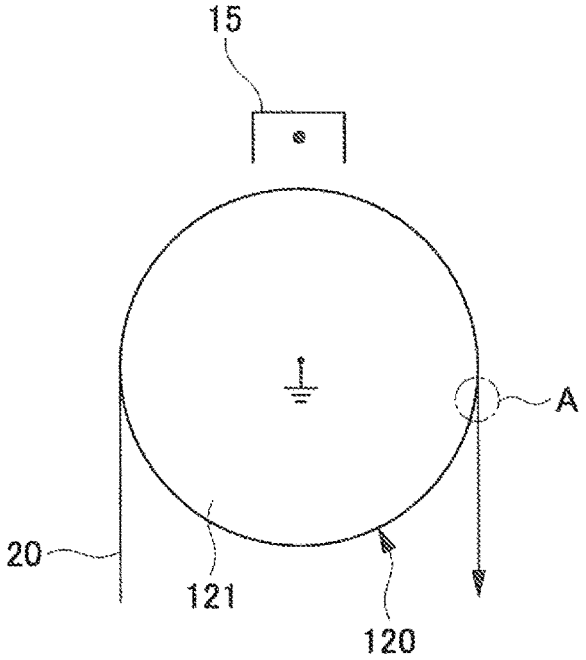
FIG. 5
FIG. 6
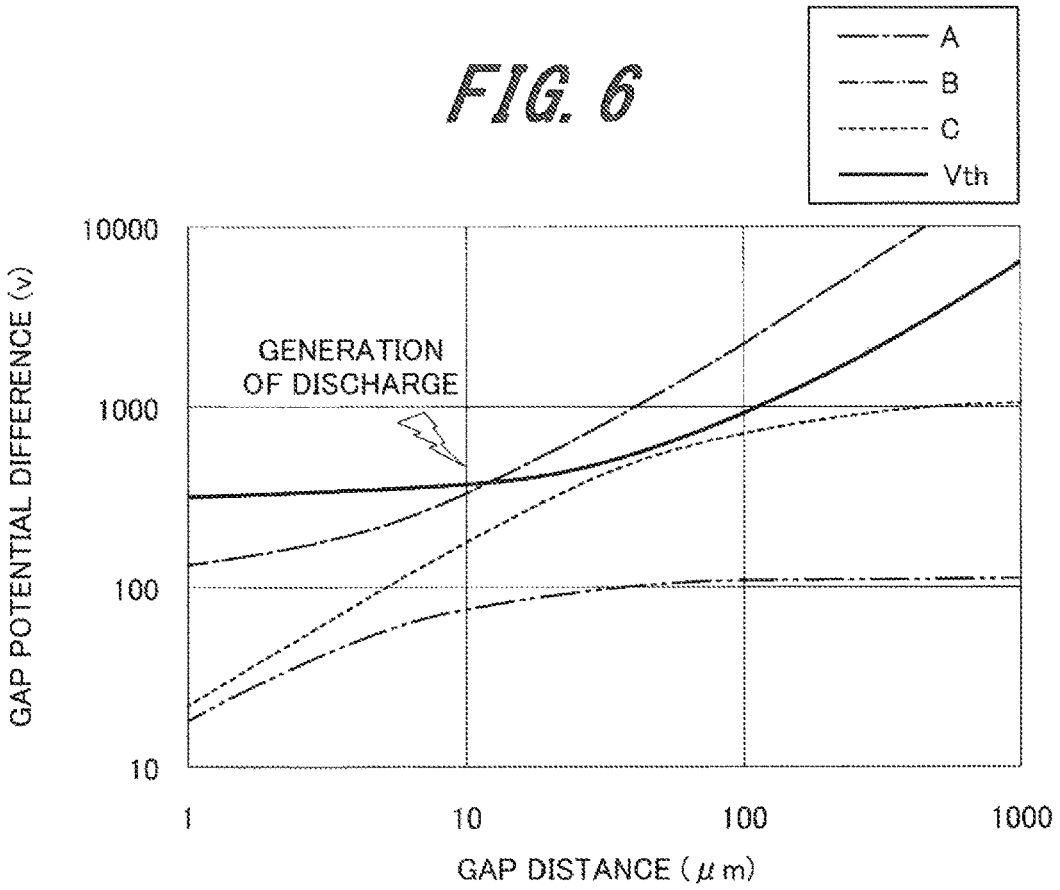

FIG. 12

TABLE 1

| | GRID VOLTAGE OF FIRST ELECTRIFICATION ADJUSTER | TONER ADHESION STATE | DISCHARGE SOUND |
|---|---|---|---|
| FIRST EXAMPLE | −50V | × | ABSENT |
| | −100V | ○ | ABSENT |
| | −150V | × | PRESENT |
| SECOND EXAMPLE | −50V | × | ABSENT |
| | −100V | ○ | ABSENT |
| | −150V | ○ | ABSENT |
| THIRD EXAMPLE | −50V | × | ABSENT |
| | −100V | ○ | ABSENT |
| | −150V | ○ | ABSENT |
| FOURTH EXAMPLE | −50V | × | ABSENT |
| | −100V | ○ | ABSENT |
| | −150V | ○ | ABSENT |
| FIRST COMPARATIVE EXAMPLE | −50V | × | PRESENT |
| | −100V | × | PRESENT |
| | −150V | × | PRESENT |
| SECOND COMPARATIVE EXAMPLE | −50V | × | ABSENT |
| | −100V | △ | ABSENT |
| | −150V | △ | ABSENT |

FIG. 13

TABLE 2

| | GRID VOLTAGE OF SECOND ELECTRIFICATION ADJUSTER | IMAGE UNIFORMITY | STAIN OF HEAD |
|---|---|---|---|
| FIFTH EXAMPLE | 0V | ○ | △ |
| | −100V | ○ | ○ |
| THIRD COMPARATIVE EXAMPLE | 0V | × | △ |
| | −100V | × | × |

TABLE 3

| | SECONDARY TRANSFER VOLTAGE | IMAGE UNIFORMITY | DENSITY |
|---|---|---|---|
| SIXTH EXAMPLE | 1500V | × | × |
| | 1750V | ○ | ○ |
| | 2000V | ○ | ○ |
| FOURTH COMPARATIVE EXAMPLE | 1500V | × | × |
| | 1750V | × | ○ |
| | 2000V | ○ | ○ |

ELECTRIFICATION ADJUSTMENT APPARATUS AND IMAGE FORMING APPARATUS

CROSS-REFERENCE TO RELATED APPLICATIONS

The entire disclosure of Japanese Patent Application No. 2018-57684, filed on Mar. 26, 2018, is incorporated herein by reference in its entirety.

BACKGROUND ART

Technological Field

The present invention relates to an electrification adjustment apparatus and an image forming apparatus.

Description of the Related Art

Charges on a sheet recording material (hereinafter referred to as a "recording material") with high insulation property such as a resin film and a synthetic paper are electrified by the frictional electrification, the separation discharge, and the corona discharge in the process of manufacturing the recording material, the surface treatment process such as the corona process, and the conveyance process, and remain on the surface without being attenuated. In most cases, those electrified charges are in the non-uniform state with uneven distribution on the recording material surface, for example, locally electrified with both positive and negative polarities. It has been known that the ink-jet (IJ) printing onto the above-described high insulating recording material generates an image noise owing to electrification of the recording material as described below.

When the recording material is electrified, the electric field formed between the electrified charge and the ink-jet head influences the flying characteristic of the ink droplet, thus changing the flying speed and the flying direction. This may cause the problem that the ink droplet reaches an unintended landing point on the recording material rather than the expected one. Especially as the small droplet is susceptible to the electric field because of large deceleration owing to air resistance, the following problems will occur. For example, the misted ink droplets (sub-droplets) are returned toward the ink-jet head side and adhering thereto by the electric field, and the ink droplets adhere to the unintended point on the recording material, resulting in scumming. The sub-droplet may be referred to as a satellite.

FIGS. 1A and 1B show a relationship between electrification of the recording material and the image noise in the ink-jet type image forming processing. FIG. 1A represents an example of a flying ink droplet injected from an ink-jet head. FIG. 1B represents an example of a state in which the ink droplet has reached the landing point.

FIG. 1A represents how the flying ink droplet is influenced. Referring to FIG. 1A, the ink droplet injected from an ink-jet head 10 includes a main droplet 11 with a large volume, and a sub-droplet 11*a* (mist) generated in the process of generating the main droplet 11. Focusing on the sub-droplet 11*a* with high air resistance as shown in FIG. 1A, it is assumed that the sub-droplet 11*a* has a positive charge. A recording material 20 is positively electrified relatively uniformly. At the location where the vertical electric field is formed as shown in FIG. 1A, the sub-droplet

11*a* receives the electrostatic force directed toward the ink-jet head 10 in the direction opposite the flying direction (center part of FIG. 1A).

At the location where the horizontal electric field is formed by electrification non-uniformity of the recording material 20 (left side and right side of FIG. 1A), as a sub-droplet 12*a* becomes proximate to the surface of the recording material 20, it receives the lateral electrostatic force. The above-described electrostatic force changes the speed and direction of the ink droplet. As a result, the sub-droplet 12*a* reaches the different landing position from the originally intended position, resulting in the image noise. If the sub-droplet 11*a* is adhering to the ink-jet head 10 under the electrostatic force, the ink-jet head 10 will be stained. Especially when the sub-droplet 11*a* is adhering to the position near the nozzle, such malfunction as injection bending and the like will occur.

It has been known that the electrified charge on the recording material 20 or the like influences the ink droplets immediately after they reach the landing points. For example, as FIG. 1B shows, under the electric field in the planar direction as a result of electrification non-uniformity of the recording material 20, the electrostatic induction occurs in a landed ink droplet 13. The electrostatic force acts in the electric field direction, causing the problem of fluctuating the dot shape. The size of the dot shape fluctuation (deformation) may be affected depending on what extent the planar electric field is cancelled by movement of the electrostatically induced charge accompanied with the dot deformation. Therefore, it is necessary to reduce the non-uniformity in the charge density of the recording material 20 so as to suppress fluctuation of the dot shape. Especially when the recording material is thin, the electrostatic capacity between the recording material surface in the presence of the electrified charges, and the electrode at the back surface side of the recording material is large. Even if the electrified potential is relatively small, the charge density may be large. In order to suppress the dot shape fluctuation, it is important to reduce the charge density non-uniformity.

There has been known a destaticizer for destaticizing the recording material with a plurality of destaticizing units as described below. Japanese Unexamined Patent Application Publication No. 8-64384 (Patent Literature 1) discloses the technology for bringing the point of the insulating web, which is to be destaticized into tight contact with the point of the grounding conductive roller facing the charging electrode to which the DC voltage is applied so that the charge is supplied to the surface of the point to be destaticized. The point to be destaticized is separated from the grounding conductive roller surface while being rotated so as to eliminate the charge at the point to be destaticized by the destaticizing electrode disposed at the same side as that of the charging electrode, downstream with respect to the insulating web surface.

Japanese Unexamined Patent Application Publication No. 2002-289394 (Patent Literature 2) discloses the technology for the destaticizing process to one surface of the insulation sheet so as to uniformize the electrification polarity on the one surface, and the electrification neutralizing process (destaticizing) from the same surface at the downstream side so that the electrification pattern on the processed surface is destaticized.

CITATION LIST

Patent Literature

Patent Literature 1: Japanese Unexamined Patent Application Publication No. 8-64384

Patent Literature 2: Japanese Unexamined Patent Application Publication No. 2002-289394

SUMMARY

In Patent Literature 1, the charging electrode at the upstream side supplies charges each with one polarity so as to reduce electrification non-uniformity, and the destaticizing electrode at the downstream side (separation part) neutralizes the entire charges. It is not possible to increase the amount of charge from the charging electrode for the purpose of suppressing the separation discharge at the separation part. Therefore, the large electrification non-uniformity cannot be sufficiently eliminated. The technology disclosed in Patent Literature 1 fails to supply the destaticizing charges to the line of electric force closed by the electrification non-uniformity of the recording material at the separation part (near the destaticizing electrode) because of large residual electrification non-uniformity.

In Patent Literature 2, at the upstream side, the charges each with one polarity are supplied to reduce the electrification non-uniformity, and at the downstream side (separation part), the entire charges are neutralized. In the case of executing the electrification neutralizing process (destaticizing) to the thin recording material with high electrostatic capacity (specific dielectric constant), the charge density of the recording material cannot be uniformized sufficiently even if the electrified potential non-uniformity is reduced. It is difficult to execute the control for eliminating the electrified potential non-uniformity to zero. In the case of large electrostatic capacity of the recording material, the potential generated by electrification on the recording material (Q=CV) becomes small. The electric field for suction of the charge supplied by the ionizer becomes small. As a result of superposing the recording material after destaticizing on the member with small electrostatic capacity, or moving the recording material apart from the conductive conveyor roller 21 (electrode), the synthetic capacity between the surface of the recording material at the ionizer side, and the electrode becomes small. Then the electrified potential non-uniformity and the potential become large.

It is preferable to have no electrification non-uniformity on the recording material surface (electrified potential non-uniformity, electrified charge non-uniformity) in another image forming process such as electrographic type for the purpose of maintaining the image quality.

It is an object of the present invention to eliminate the electrification non-uniformity on the recording material surface as a factor that affects the image quality, and to suppress unnecessary influence of the electric field.

To achieve the above-described object, according to an aspect of the present invention, an electrification adjustment apparatus reflecting one aspect of the present invention includes a conveyor member for conveying a recording material, a first electrification adjuster disposed to face the recording material being conveyed for supplying a charge with one polarity, a second electrification adjuster disposed to face the recording material at a downstream side of the first electrification adjuster in a conveying direction for supplying a charge with opposite polarity to the polarity of the charge supplied by the first electrification adjuster, a first DC power supply for a DC power supply to the first electrification adjuster, and a second DC power supply for a DC power supply having a polarity opposite to the polarity of the first DC power supply to the second electrification adjuster. In the electrification adjustment apparatus, an electrostatic capacity between a surface of the recording material, which faces the second electrification adjuster and an electrode partially or entirely formed from the conveyor member is smaller than an electrostatic capacity between a surface of the recording material, which faces the first electrification adjuster and an electrode partially or entirely formed from the conveyor member, and any one of the surface and a back surface of the recording material is in contact with (not separated from) the conveyor member in a region between the first electrification adjuster and the second electrification adjuster.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 3 shows graphs each representing an example of an electrified charge and an electrified potential at each position on each part of the electrification adjustment apparatus according to the first embodiment of the present invention;

FIG. 4 is an explanatory view representing an electrostatic capacity on the surface of each guide member according to the first embodiment of the present invention;

FIG. 5 is an explanatory view showing an example of a generally employed electrification adjustment apparatus;

FIG. 6 is a graph indicating a result of calculating a gap potential difference with respect to a gap distance between the guide member and the recording material according to the first embodiment of the present invention;

FIG. 12 is a table showing measurement results derived from the first to the fourth examples, and the first and the second comparative examples;

FIG. 13 is a table showing measurement results derived from the fifth example and the third comparative example;

DETAILED DESCRIPTION OF EMBODIMENTS

Hereinafter, an example of one or more modes for carrying out the present invention (hereinafter referred to as "embodiments") will be described referring to the attached drawings. However, the scope of the invention is not limited to the disclosed embodiments. In the specification and the drawings, components with substantially the same functions or the same structures will be designated with the same codes, and explanations thereof, thus will be omitted.

First Embodiment

Structure of Electrification Adjustment Apparatus

A structure example of an electrification adjustment apparatus according to a first embodiment of the present invention will be described.

Figure 2:
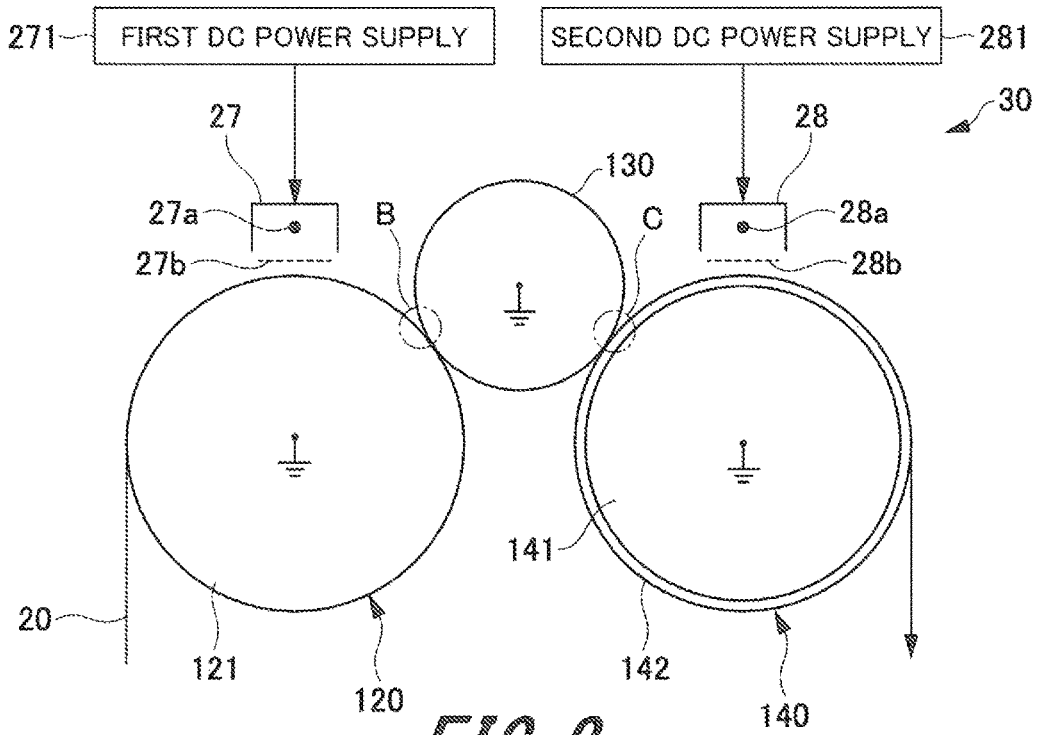
FIG. 2 is an explanatory view showing an example of an electrification adjustment apparatus according to a first embodiment of the present invention.

FIG. 2 is an explanatory view showing an example of the electrification adjustment apparatus according to the first embodiment of the present invention.

An electrification adjustment apparatus 30 as shown in FIG. 2 is exemplified as the electrification adjustment apparatus to be disposed on a conveying path of an ink-jet recording apparatus, for example. The electrification adjustment apparatus 30 includes a first guide member 120, a second guide member 140, an intermediate guide member 130, a first electrification adjuster 27, a second electrification adjuster 28, a first DC power supply 271, and a second DC power supply 281.

Each of the first guide member 120, the second guide member 140, and the intermediate guide member 130 is structured to have a surface in contact with the conveyed recording material 20. The second guide member 140 is disposed at the downstream side of the first guide member 120 in the conveying direction. The intermediate guide member 130 is disposed between the first guide member 120 and the second guide member 140 so as to be in abutment with both members via the recording material 20. Each of the first guide member 120, the second guide member 140, and the intermediate guide member 130 as an example of the conveyor member is constituted by a rotary body such as a roller having a rotary axis perpendicular to the conveying direction.

The first guide member 120 is formed as a metal roller 121 (example of a conductive roller with low resistance) made of aluminum, for example, and grounded. The second guide member 140 is formed as a metal roller 141 made of aluminum having its surface coated with an insulation layer 142, and grounded. The metal rollers 121, 141 are exemplified as electrodes each constituted from the conveyor member either partially or entirely. The insulation layer 142 is made of an insulating resin, for example. The insulation layer 142 functions as a heat insulation layer for suppressing fluctuation of the temperature of the second guide member 140 owing to heat generated upon ultraviolet ray curing in a fixing unit 25.

The insulating recording material 20 subjected to the electrification adjustment is conveyed while being wound on the respective surfaces of the first guide member 120, the intermediate guide member 130, and the second guide member 140 sequentially. The intermediate guide member 130 regulates the conveying path for the recording material 20 kept in a tensed state.

The first DC power supply 271 is a power supply circuit for supplying DC voltage (first DC power supply) to the first electrification adjuster 27. The second DC power supply 281 is a power supply circuit for supplying DC voltage (second DC power supply) with opposite polarity to that of the first DC power supply 271 to the second electrification adjuster 28.

The first electrification adjuster 27 is disposed to face the surface of the first guide member 120. As the recording material 20 is conveyed to the first guide member 120, the first electrification adjuster 27 is positioned to face the surface of the recording material 20, which is not in contact with the first guide member 120. Upon reception of the DC voltage applied from the first DC power supply 271, the first electrification adjuster 27 generates the charge with one polarity so as to be supplied to the first guide member 120. The electric field is formed between the voltage applied to the first electrification adjuster 27 and the grounded first guide member 120 so that the charge is supplied to the recording material 20 which is wound on the surface of the first guide member 120.

The second electrification adjuster 28 is disposed to face the surface of the second guide member 140. As the recording material 20 is conveyed to the second guide member 140, the second electrification adjuster 28 is positioned to face the surface of the recording material 20, which is not in contact with the second guide member 140. Upon reception of the DC voltage applied from the second DC power supply 281, the second electrification adjuster 28 generates the charge with opposite polarity to that of the charge supplied form the first electrification adjuster 27 so that the generated charge with the opposite polarity is supplied to the second guide member 140. The electric field is generated between the potential of the second electrification adjuster 28 in accordance with the applied DC voltage and the electrified charge of the recording material 20 on the grounded second guide member 140 so that the charge with the opposite polarity is supplied to the recording material 20 wound on the surface (insulation layer 142) of the second guide member 140.

The corona electrifier and the roller electrifier may be employed for the first electrification adjuster 27 and the second electrification adjuster 28. The present embodiment is configured to employ the scorotron electrifier (a kind of the corona electrifier) having a grid electrode 27*b* (28*b*) disposed between a wire-like corona discharge electrode 27*a* (28*a*) extending in a main scanning direction and an electrification body (the recording material 20 in the present embodiment). The scorotron electrifier adjusts the charge amount to be supplied to the recording material 20 via the grid electrode 27*b* utilizing the voltage to be applied to the grid electrode 27*b*. Specifically, it is possible to provide two separate functions, that is, the function for generating charges by the corona discharge electrode 27*a* (28*a*), and the function for forming the electric field by the grid electrode 27*b* (28*b*) so as to secure the charge supply amount in accordance with the electrostatic capacity of the recording material 20. The scorotron electrifier allows the grid electrode 27*b* (28*b*) for forming the electric field to be disposed adjacent to the recording material 20. Accordingly, it is preferable to employ the scorotron electrifier in terms of uniformizing the electrification non-uniformity, and adjusting the electrified amount.

The intermediate guide member 130 is a conductive roller (for example, the metal roller) disposed in abutment with both the first guide member 120 and the second guide member 140. It is preferable to form the intermediate guide member 130 as the roller with the surface onto which an elastic member is applied for securing the contact with both the first guide member 120 and the second guide member 140. As the intermediate guide member 130 is interposed between the first guide member 120 and the second guide member 140, the recording material 20 electrified by the first electrification adjuster 27 is conveyed to the second electrification adjuster 28 while having its surface either front or back surface constantly kept in contact with any one of the first guide member 120, the intermediate guide member 130, and the second guide member 140.

Each of the first guide member 120, the second guide member 140, and the intermediate guide member 130 may be formed as the fixed member instead of the rotatable roller. The use of the roller may suppress wear on the surface of the recording material 20.

In the present embodiment, the recording material 20 subjected to the electrification adjustment is assumed to be a resin film, and the recording material with electrically high resistance. The synthetic paper and the coated paper may be the high resistance paper. In the case of low humidity, the resistance of the paper becomes higher than that of the paper at the normal humidity. The above-described paper may also be the one to be subjected to the electrification adjustment.

Electrification Adjustment Operation

An electrification adjustment performed by the electrification adjustment apparatus 30 (the process for uniformly destaticizing the non-uniform electrification state) will be described referring to FIG. 3. Each of graphs (1) to (8) shown in FIG. 3 represents an example of the electrified charge and the electrified potential at each position on the recording material 20 located at the respective parts of the electrification adjustment apparatus 30. Each x-axis of the graphs (1) to (8) shown in FIG. 3 represents the position on the recording material 20, each y-axis shown in FIG. 3 (corresponding to odd numbers) represents the charge density, and each y-axis shown in FIG. 3 (corresponding to even number) represents the electrified potential.

Figures 1A, 1B:
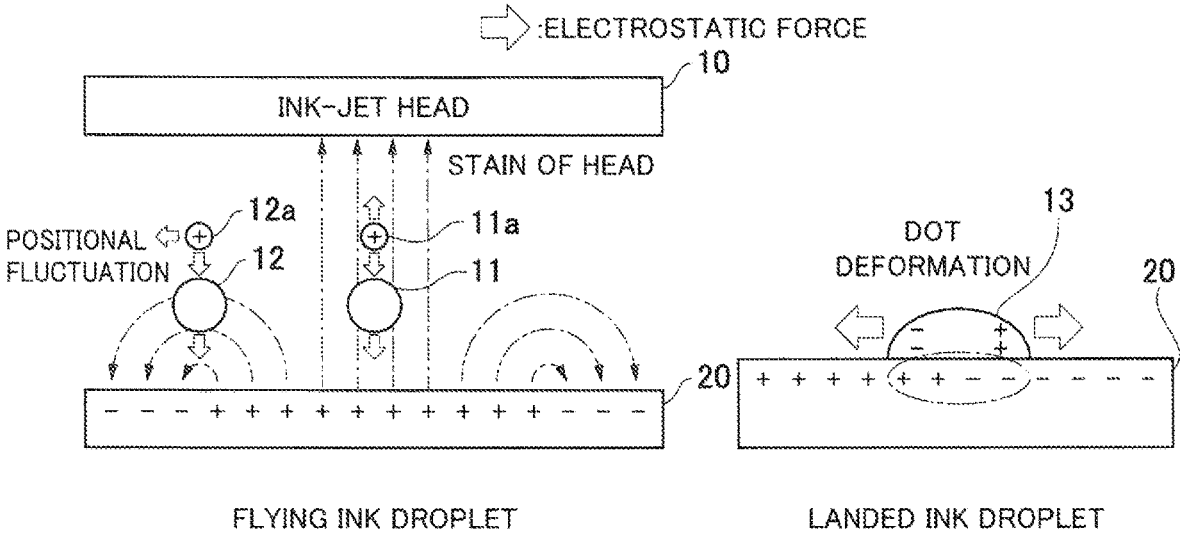
FIGS. 1A and 1B are explanatory views representing a relationship between electrification of a recording material and an image noise in an ink-jet type image forming process.

As the graph (1) of Fi. 3 shows, in the presence of electrified charges with non-uniformity on the surface of the insulating recording material 20, the electrified potential in accordance with the charge density non-uniformity is formed on the surface around the region as described above (solid line in the graph (2) of FIG. 3). However, as the left and right sides of FIG. 1A show, the charges with opposite polarities around the surface of the recording material 20 may close the electric line of force. Therefore, as the distance from the surface becomes farther, the electrified potential affected by the charge density with non-uniformity is averaged (see broken line of the graph (2) of FIG. 3). The ion generator (electrifier) generally employed for destaticizing purpose allows suction of the generated charges at the electrified potential formed by the electrified charges (see broken line of the graph (2) of FIG. 3). Upon neutralization of the electrified charges through averaging, the electrostatic force directed to the recording material 20 does not act on the charge with either polarity, thus failing to sufficiently destaticize the non-uniform electrification on the surface of the recording material 20 as described above.

The first electrification adjuster 27 is configured to generate the charge with one polarity (negative charge in this case), and form the electric field that ensures sufficient supply of charges between the first electrification adjuster 27 and the first guide member 120 so that the recording material 20 is entirely electrified with the polarity. This makes it possible to supply the charge to the region with the closed electric line of force on the surface of the recording material 20 (see FIG. 1A). As a result, the charge moves along the electric line of force in accordance with the electrification non-uniformity, thus reducing the electrification non-uniformity (see graphs (3), (4) of FIG. 3). In the above-described case, preferably, the first electrification adjuster 27 supplies sufficient charge amount compared with the one which causes the electrification non-uniformity on the surface of the recording material 20 (electrification with one polarity).

Increase in the electrostatic capacity of the recording material 20 to be electrified may reduce the extent of increase in the electrified potential by the supplied charge so as to reduce the electric field formed by the first electrification adjuster 27 (possible to supply sufficient charge at low voltage). It is preferable to maximize the electrostatic capacity on the surface of the first guide member 120 by employing the conductive roller as the first guide member 120 having its surface in contact with the recording material 20 (on the back surface of the recording material 20). In the present embodiment, the metal roller 121 is used for the first guide member 120.

The second guide member 140 has its surface applied with the insulation layer 142, on which the recording material 20 is superposed. As FIG. 4 shows, in the region covered by the second electrification adjuster 28, a synthetic electrostatic capacity C2 of an electrostatic capacity C1 of the recording material 20 and an electrostatic capacity CO of the insulation layer 142 (the electrostatic capacity on the surface of the second guide member 140) is smaller than the electrostatic capacity in the region covered by the first electrification adjuster 27. The region covered by the first electrification adjuster 27 refers to the range influenced by the charge generated by the first electrification adjuster 27 (electrification adjustable area). The region covered by the second electrification adjuster 28 may also be defined correspondingly. The electrified potential of the second electrification adjuster 28 becomes higher than the one derived from the charge (see graph (5) of FIG. 3) electrified by the first electrification adjuster 27 by the amount corresponding to a potential difference g (see graph (6) of FIG. 3). As described above, in the region covered by the second electrification adjuster 28, the electrostatic capacity is small, and the electrified potential largely changes relative to the electrified charge amount.

The second electrification adjuster 28 supplies appropriate amount of charges each with opposite polarity to that of the charge supplied by the first electrification adjuster 27 by utilizing the electrified potential as shown in the graph (6) of FIG. 3 so that the electrified amount of the recording material 20 reaches the required level (level zero in the embodiment). The second electrification adjuster 28 adjusts the electrified potential of the recording material 20 conveyed on the second guide member 140 to be approximated to 0V (see graph (8) of FIG. 3). This makes it possible to approximate the charge amount electrified on the recording material 20 to the target value (preferably, 0) (see graph (7) of FIG. 3).

For uniformization of the electrification non-uniformity as described above, the first electrification adjuster 27 supplies sufficient amount of charges to the region with electrification non-uniformity of the recording material 20 (by increasing the electrostatic capacity of the first electrification adjuster 27), and the second electrification adjuster 28 with less electrostatic capacity adjusts the charge amount on the surface of the recording material 20. For example, the charge amount to be supplied by the first electrification adjuster 27 is determined based on the empirically obtained value, and the value preliminarily derived from the experiment, and the determined value is registered in a storage unit 44 (to be described later referring to FIG. 11). It is preferable to provide the intermediate guide member 130 in contact with both the first guide member 120 and the second guide member 140 so as not to generate the separation discharge when conveying the recording material 20 from the first guide member 120 to the second guide member 140. The embodiment is configured to change the electrostatic capacity on the region covered between the first electrification adjuster 27 and the electrification adjuster 28 while having the recording material 20 to be conveyed being in contact with the intermediate guide member 130.

Function of Intermediate Guide Member

A function of the intermediate guide member 130 will be described referring to FIGS. 5 and 6. FIG. 5 is an explanatory view showing an example of a generally employed electrification adjuster. Referring to FIG. 5, an electrification adjuster 15 supplies the charge with one polarity to the recording material 20 to be conveyed by the first guide member 120 as the conductive roller. The electrification adjuster 15 is a corona electrifier with no grid electrode. FIG. 6 is a graph showing results of calculating a gap potential difference with respect to a gap distance between the guide member and the recording material 20.

Referring to FIG. 5, upon separation of the recording material 20 from the first guide member 120 having its surface electrified, a gap (gap A) is formed between the first guide member 120 and the recording material 20. A gap potential difference of the gap is obtained for comparative purpose so as to explain how the intermediate guide member 130 functions. Furthermore, referring to FIG. 2, a gap potential difference at an inlet B of a nip part between the second guide member 140 and the intermediate guide member 130, and a gap potential difference at an outlet C of a nip part between the intermediate guide member 130 and the second guide member 140 are obtained.

FIG. 6 shows results of calculating each gap potential difference with respect to the gap distance, where the recording material 20 has the electrified charge density of 200 $\mu C/m^2$, the thickness of 10 μm, the specific dielectric constant of 2, and the insulation layer 142 on the surface of the second guide member 140 has the thickness of 100 μm, and the specific dielectric constant of 2. FIG. 6 also shows the calculation result of an approximate equation (Vth=312+6.2 d (d: gap distance, unit: μm)) for an insulation breakdown voltage Vth of an air layer in accordance with Paschen's law. Upon separation of the electrified recording material 20 from the first guide member 120, discharge occurred in the structure shown in FIG. 5 at the position around the region with the gap distance in excess of 10 μm. Compared with the above-described structure in FIG. 5, the structure as shown in FIG. 2 having the intermediate guide member 130 is capable of suppressing the gap potential difference to the low level as well as the separation discharge.

As described above, the first embodiment includes the first electrification adjuster 27 disposed at the upstream side of the direction for conveying the recording material 20, and the second electrification adjuster 28 disposed at the downstream side. The charge supplied by the first electrification adjuster 27 has an opposite polarity to that of the charge supplied by the second electrification adjuster 28. In the present embodiment, the electrostatic capacity between the surface (non-contact surface) of the recording material 20 in contact with the second guide member 140 and the electrode of the second guide member 140 is smaller than the electrostatic capacity between the surface (non-contact surface) of the recording material 20 in contact with the first guide member 120 and the electrode of the first guide member 120. In other words, the electrostatic capacity between the surface of the recording material 20 facing the second electrification adjuster 28 and the electrode of the second guide member 140 is smaller than the electrostatic capacity between the surface of the recording material 20 facing the first electrification adjuster 27 and the electrode of the first guide member 120.

In the above described embodiment, as the electrostatic capacity at the side of the first electrification adjuster 27 is large, fluctuation in the potential on the surface of the recording material 20 (electrified potential) owing to the electrified charge non-uniformity is small, and the charge may be easily supplied to the recording material 20. It is therefore possible to reduce the electrification non-uniformity by electrifying the recording material 20 to one polarity in spite of the electrified potential non-uniformity on the recording material 20. Meanwhile, as the electrostatic capacity at the side of the second electrification adjuster 28 is small, it is possible to further reduce the charge density non-uniformity on the recording material 20 subjected to uniformization of the potential on the surface thereof.

The embodiment employs the intermediate guide member 130 which allows either the front surface or the back surface of the recording material 20 to be in contact with the first guide member 120 or the second guide member 140 for the purpose of suppressing the separation discharge considered as a risk which may occur when switching the electrostatic capacity in the region covered between the first electrification adjuster 27 and the second electrification adjuster 28. This makes it possible to extend the upper limit of the charge amount supplied by the first electrification adjuster 27, as well as to eliminate larger electrification non-uniformity on the recording material 20.

Second Embodiment

In a second embodiment, another structure is described for obtaining the effect of the present invention by suppressing the separation discharge as an example in which arrangement of the second electrification adjuster 28 according to the first embodiment is changed.

Figure 7:
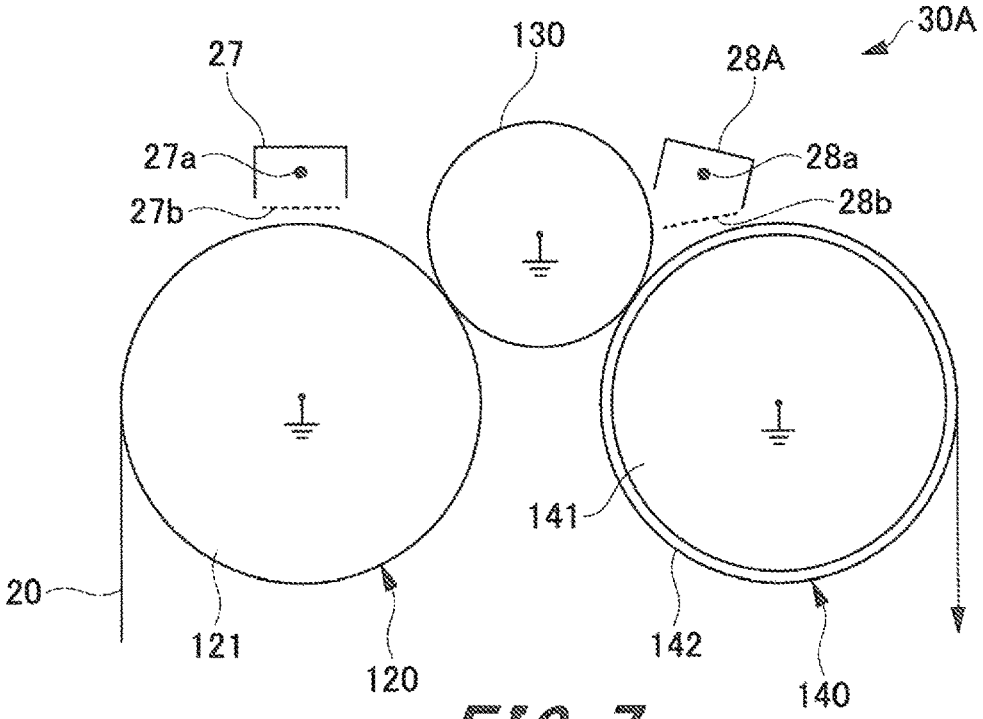
FIG. 7 is an explanatory view showing an example of an electrification adjustment apparatus according to a second embodiment of the present invention.

FIG. 7 is an explanatory view of an example of the electrification adjustment apparatus according to the second embodiment.

In the above-described first embodiment, the gap potential difference at the outlet C of the nip part formed between the intermediate guide member 130 and the second guide member 140 becomes large, which may cause the separation discharge. An electrification adjustment apparatus 30A as shown in FIG. 7 is configured to arrange a second electrification adjuster 28A to face the outlet C of the nip part between the intermediate guide member 130 and the second guide member 140.

The second electrification adjuster 28A is disposed near the outlet C of the nip part so as to intensify the electric field formed between the grid electrode **28*b* and the recording material 20 on the second guide member 140 positioned at the outlet C of the nip part. The charge may be supplied to the outlet C of the nip part between the intermediate guide member 130 and the second guide member 140, suppressing increase in the gap potential difference at the outlet C of the nip part. In this case, it is preferable not only to dispose the second electrification adjuster 28A to face the nip part between the second guide member 140 and the intermediate guide member 130, but also to dispose the grid electrode 28*b*** proximally to the surface of the second guide member 140 from the perspective of appropriate charge supply to the recording material 20.

Third Embodiment

In a third embodiment, another structure is described for obtaining the effect of the present invention by suppressing the separation discharge as an example in which a voltage is applied to the intermediate guide member 130 according to the first embodiment.

Figure 8:
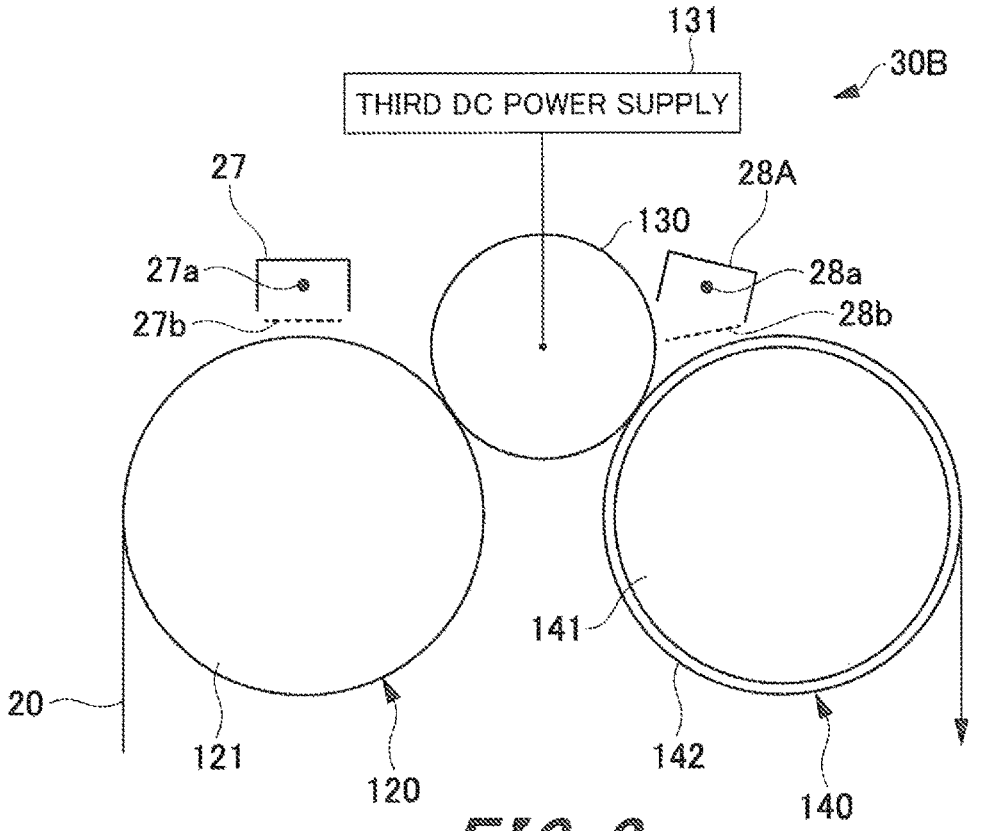
FIG. 8 is an explanatory view showing an example of an electrification adjustment apparatus according to a third embodiment of the present invention.

FIG. 8 is an explanatory view of an example of an electrification adjustment apparatus according to the third embodiment.

An electrification adjustment apparatus 30B as shown in FIG. 8 includes a third DC power supply 131 (power supply circuit) for applying the DC voltage with the same polarity as that of the charge supplied by the first electrification adjuster 27 to the intermediate guide member 130. As described above, the third DC power supply 131 applies the voltage with the same polarity as that of the charge supplied by the first electrification adjuster 27 to the intermediate guide member 130. As a result, increase in the gap potential difference may be slowed down, and the separation discharge may be prevented.

Fourth Embodiment

In a fourth embodiment, another structure is described for obtaining the effect of the present invention by suppressing the separation discharge as an example in which the first guide member 120 and the second guide member 140 according to the first embodiment are integrally structured.

Figure 9:
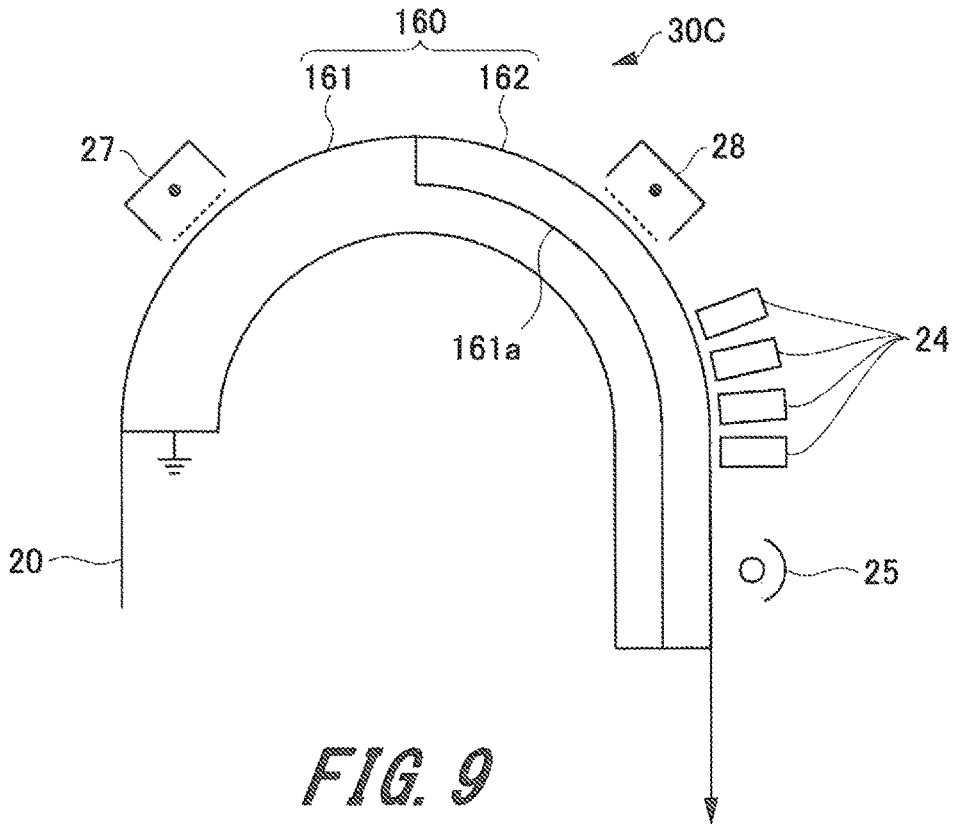
FIG. 9 is an explanatory view showing an example of an electrification adjustment apparatus according to a fourth embodiment of the present invention.

FIG. 9 is an explanatory view showing an example of an electrification adjustment apparatus according to the fourth embodiment.

An electrification adjustment apparatus 30C as shown in FIG. 9 includes a guide member 160 (an example of a conveyor member) formed by integrating a first guide 161 having a surface in contact with the recording material 20, which faces the first electrification adjuster 27, and a second guide 162 having a surface in contact with the recording material 20, which faces the second electrification adjuster 28 while being contiguous to each other. The guide member 160 on which the recording material 20 is wound has the function for guiding the recording material 20 while being conveyed.

The first guide 161 has a cylindrical shape (having an annular cross section (substantially semicircular shape in FIG. 9)) with a center axis in an orthogonal direction (main scanning direction) to the rotating direction of the recording material 20. A notch 161*a* with a depth corresponding to the thickness of the second guide 162 is formed from an arbitrary part (the highest point in FIG. 9) to the end at the downstream side on an outer circumferential surface of the first guide 161. The second guide 162 is formed in contact with the surface of the notch 161*a* of the first guide 161. Surfaces of the first guide 161 and the second guide 162, which are brought into contact with the recording material 20 form a single contiguous smooth surface with no stepped part.

For example, the first guide 161 is formed as a curved conductor (metal and the like), and the second guide 162 is formed as a curved insulating resin. In the present embodiment, the above-described structure and the selected material allow the electrostatic capacity at the second guide side to be smaller than the electrostatic capacity at the first guide side. The guide member 160 constituted by the first guide 161 and the second guide 162 is an example of the electrode constituted partially or entirely from the conveyor member.

As FIG. 9 shows, four head units 24 (see FIG. 11 to be described later) corresponding to yellow (Y), magenta (M), cyan (C), and black (B) are disposed to face the second guide 162, and the fixing unit 25 is disposed at the downstream side of the head units 24 (see FIG. 11 to be described later).

In the case of the above-structured fourth embodiment, upon switching of the electrostatic capacity in the region covered between the first electrification adjuster 27 and the second electrification adjuster 28, the recording material 20 is conveyed while having its back surface in contact with the first guide 161 and the second guide 162 of the guide member 160. Therefore, the gap where the separation discharge occurs is not formed. This structure eliminates the intermediate guide member 130, thus securing the compact electrification adjustment apparatus.

Fifth Embodiment

Structure of Ink-Jet Recording Apparatus

In a fifth embodiment, a structure example of an ink-jet recording apparatus with the electrification adjustment apparatus is described. The present embodiment will be described with respect to the ink-jet recording apparatus with the electrification adjustment apparatus 30 according to the first embodiment as an example. It is possible to employ the electrification adjustment apparatus according to another embodiment for the ink-jet recording apparatus.

Figure 10:
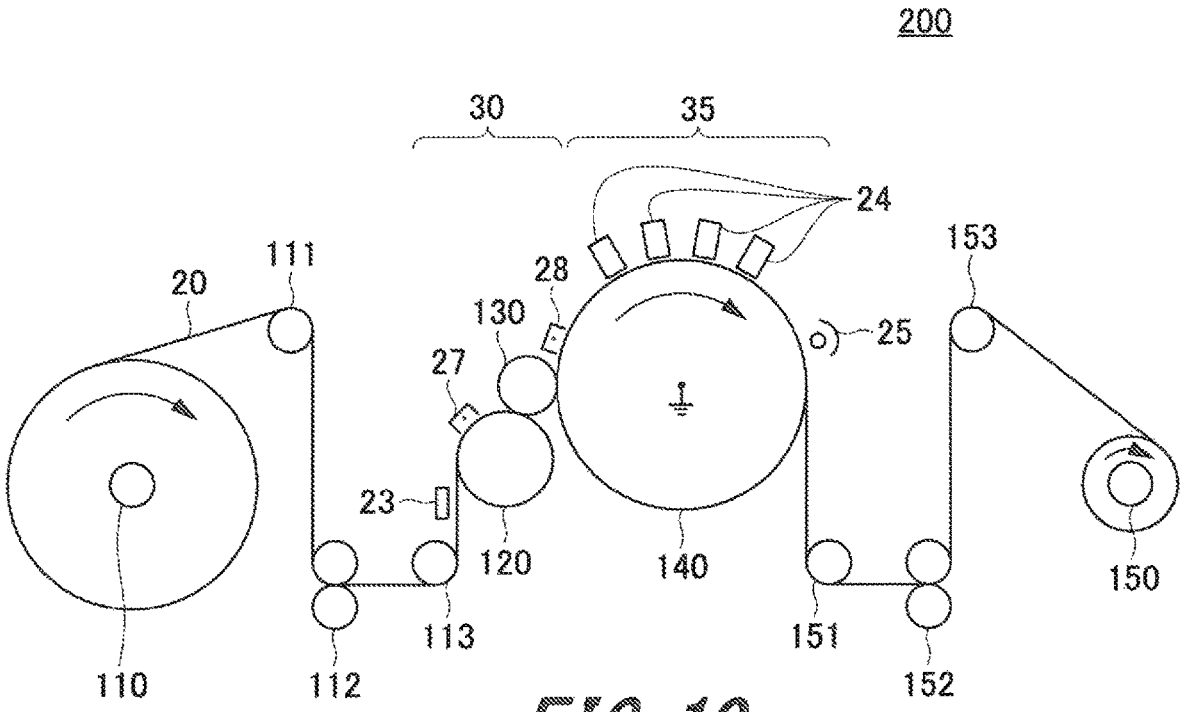
FIG. 10 is an explanatory view showing a structure example of an ink-jet recording apparatus with the electrification adjustment apparatus as shown in FIG. 2 according to a fifth embodiment of the present invention.

FIG. 10 is an explanatory view showing a structure example of an ink-jet recording apparatus with the electrification adjustment apparatus 30 as shown in FIG. 2. An ink-jet recording apparatus 200 as shown in FIG. 10 is an example of the image forming apparatus to which the present invention is applied.

As FIG. 10 shows, the ink-jet recording apparatus 200 includes a feed roll 110 on which the recording material 20 is wound, the electrification adjustment apparatus 30, an image forming unit 35 including head units 24 corresponding to the respective basic colors, and a winding roll 150 for winding the recording material 20 on which the image has been formed. The ink-jet recording apparatus 200 includes a conveyor mechanism constituted by a conveyor roller and a driven roller for conveying the recording material 20 fed from the feed roll 110 to the winding roll 150 via the electrification adjustment apparatus 30 and the image forming unit 35. Referring to the example shown in FIG. 10, a driven roller 111, a conveyor roller pair 112, and a driven roller 113 are disposed between the feed roll 110 and the electrification adjustment apparatus 30 (first guide member 120). A driven roller 151, a conveyor roller pair 152, and a driven roller 153 are disposed between the image forming unit 35 (second guide member 140) and the winding roll 150.

The electrification adjustment apparatus 30 uniformizes the electrification non-uniformity on the recording material 20, having its image forming surface on which an image is formed in the ink-jet process executed by the image forming unit 35 disposed at the downstream side. Specifically, the image is formed on the recording material 20 by means of ink-jet heads 242 (see FIG. 11) each provided with ultraviolet-curable type ink (hereinafter simply referred to as "ink") corresponding to yellow, magenta, cyan, and black, respectively. The ink is cured by a light source for UV irradiation (UV lamp) of the fixing unit 25 at the downstream side, providing the fixed image.

It is possible to form a predetermined electric field between the ink-jet head 242 and the recording material 20 through adjustment of the electrified potential of the recording material 20 performed by the second electrification adjuster 28 in accordance with the electrification characteristic (electrified polarity) of the ink droplet. Even in the case that the recording material 20 is electrified to the predetermined electrified potential by the second electrification adjuster 28, it is preferable to form images in the ink-jet process, and to perform the UV curing process on the second guide member 140 which faces the second electrification adjuster 28. This makes it possible to form the image under the appropriate control of the electric field between the ink-jet head 242 and the recording material 20 without having the electrified potential adjusted by the second electrification adjuster 28, and the image formed in the ink-jet process being disturbed by the separation discharge.

In the present embodiment, the ink-jet recording apparatus 200 using the ultraviolet-curable type ink has been described as an example. However, the image forming method is not limited to the one as described above. It is possible to use the aqueous ink, the solvent-base ink and the like for forming images. Arbitrary types, or arbitrary number of colors may be used for forming the image without being limited to those described above.

Control System for Ink-Jet Recording Apparatus

The structure of the control system for the ink-jet recording apparatus 200 will be described referring to FIG. 11. FIG. 11 is a block diagram showing a structure example of the control system for the ink-jet recording apparatus 200.

Figure 11:
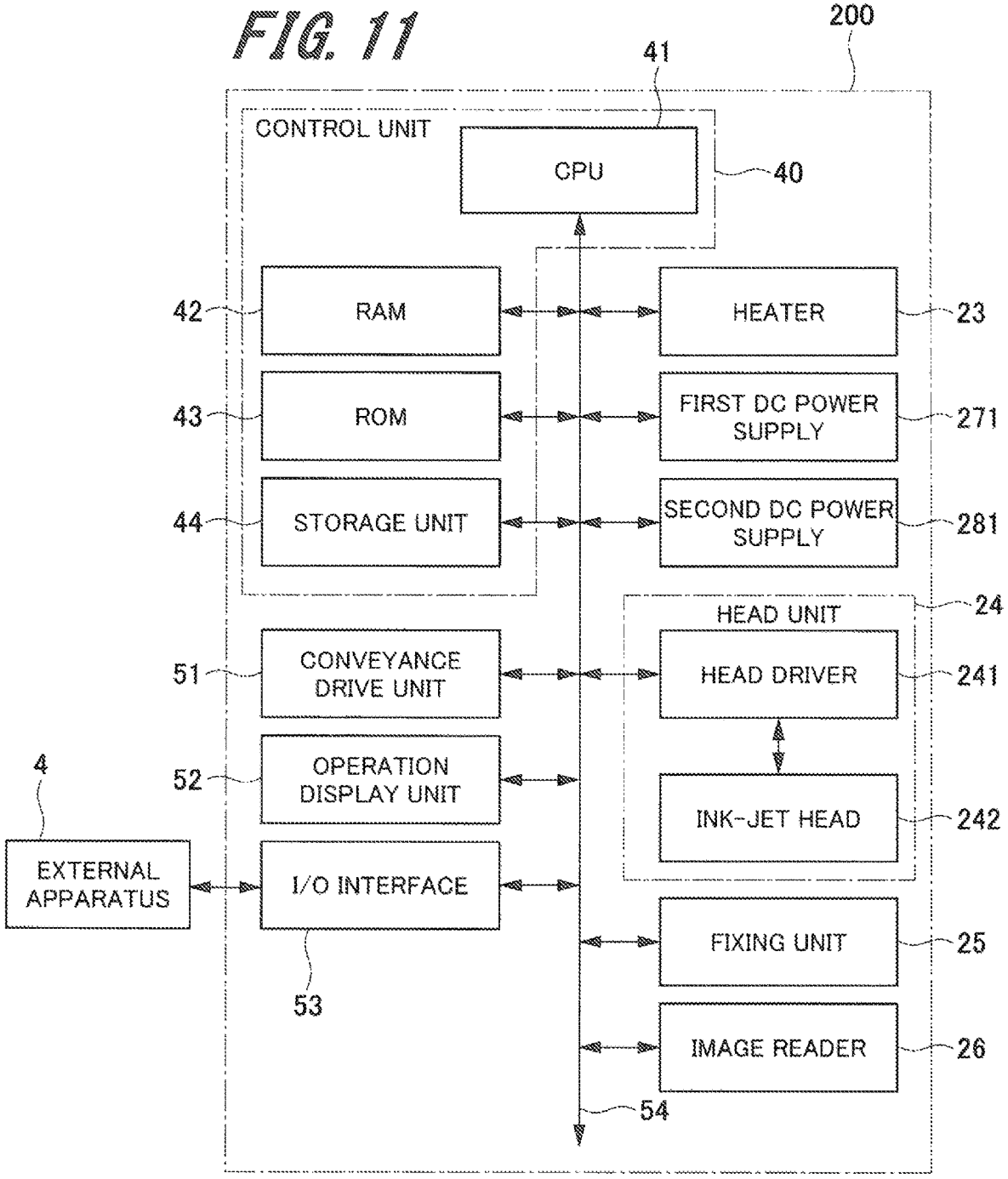
FIG. 11 is a block diagram showing an example of a control system for the ink-jet recording apparatus as shown in FIG. 10 according to the fifth embodiment of the present invention.

As FIG. 11 shows, the ink-jet recording apparatus 200 includes a control unit 40. The control unit 40 includes a CPU (Central Processing Unit) 41, a RAM (Random Access Memory) 42 used as a work area for the CPU 41, and a ROM (Read Only Memory) 43 for storing the program and the like to be executed by the CPU 41, for example. The control unit 40 further includes a storage unit 44 as a mass storage device such as a hard disk drive (HDD). The storage unit 44 stores image data read by an image reader 26, the information for executing the electrification adjustment, the test chart for detecting the discharge fault of the nozzle of the ink-jet head 242, and the information for detecting the discharge fault of the nozzle.

The ink-jet recording apparatus 200 includes a conveyance drive unit 51 for driving the conveyor system, for example, a not shown image forming drum, a paper ejection unit, a paper reversing unit and the like, an operation display unit 52, and an I/O interface 53.

The CPU 41 of the control unit 40 is connected to a heater 23, the head unit 24, the fixing unit 25, the image reader 26, the RAM 42, the ROM 43, and the storage unit 44 via a system bus 54 so as to control the entire apparatus. The CPU 41 is connected to the conveyance drive unit 51, the operation display unit 52, and the I/O interface 53 via the system bus 54.

The operation display unit 52 is a touch panel constituted as a display, for example, a liquid crystal display (LCD) or an organic ELD (Electro Luminescence Display). The operation display unit 52 displays an instruction menu for the user, and information relating to the nozzle discharge detection operation, and the acquired image data. Furthermore, the operation display unit 52 includes a plurality of keys functioning as an input unit for receiving inputs of data such as various instructions, characters, and figures through the user's key operation.

The I/O interface 53 is communicably connected to an external apparatus 4. The I/O interface 53 receives a print job (image data, output setting) from the external apparatus 4. The I/O interface 53 outputs the received image data to the control unit 40. The control unit 40 subjects the image data received from the I/O interface 53 to image processing. The control unit 40 may be configured to execute the image processing to the received image data as needed, for example, the shading correction, the image density adjustment, and the image compression.

The head unit 24 receives the image data which have been processed by the control unit 40 so as to form a predetermined image on the recording material 20 based on the image data. Specifically, the head unit 24 drives a head driver 241 to allow the ink-jet head 242 to discharge the ink to the predetermined position. The heater 23 for heat generation is disposed at the upstream side of the head unit 24 so that the recording material 20 passing therearound has the predetermined temperature under the control of the control unit 40.

The four head units 24 are disposed corresponding to colors of yellow (Y), magenta (M), cyan (C), and black (K), respectively. The four head units 24 corresponding to yellow, magenta, cyan, black are arranged sequentially in order from the upstream side in the direction for conveying the recording material 20.

The head unit 24 is set to have a length (width) sufficient to entirely cover the recording material 20 in the direction orthogonal to the one for conveying the recording material 20 (main scanning direction). In other words, the ink-jet recording apparatus 200 is of line head type as a one-pass system. Each of the four head units 24 has the same structure except the color of the ink to be discharged.

In the present embodiment, prior to the image formation by the head units 24 onto the recording material 20, the control unit 40 controls the first DC power supply 271 and the second DC power supply 281 so that charges supplied from the first electrification adjuster 27 and the second electrification adjuster 28 are regulated to adjust electrification of the recording material 20 (see FIG. 2). Based on the information relating to the kind of the recording material 20 (for example, the information about resistance, specific dielectric constant, and thickness), and image forming conditions (for example, density of image, and printing area rate), the control unit 40 adjusts the amount of charge supplied from the first electrification adjuster 27 and the second electrification adjuster 28.

The image formed on the recording material 20 by the head units 24 is read by the image reader 26. The read image data are transmitted to the control unit 40. Upon detection of the nozzle discharge fault, the control unit 40 identifies the nozzle having the discharge fault based on the image data transmitted from the image reader 26. The control unit 40 executes the correction process to the head unit 24 by increasing the discharge amount of the ink from the nozzle adjacent to the one having the discharge fault.

Measurement Results

Effects of the electrification adjustment performed by the respective embodiments have been confirmed using structures of examples and comparative examples, and confirmation results will be described referring to FIGS. 12 and 13.

FIG. 12 is a table showing measurement results derived from the first to the fourth examples, and the first and the second comparative examples.

FIG. 13 is a table showing measurement results derived from the fifth example and the third comparative example.

First Example

The first example employed the electrification adjustment apparatus 30 (each of the electrification adjusters 27, 28 was a scorotron electrifier) as shown in FIG. 2. A PET (polyethylene terephthalate) layer with thickness of 100 μm functioning as the insulation layer 142 was formed on the surface of the second guide member 140.

Second Example

The second example employed the electrification adjustment apparatus 30B (each of the electrification adjusters 27, 28 was the scorotron electrifier) as shown in FIG. 8. The PET layer with thickness of 100 μm functioning as the insulation layer 142 was formed on the surface of the second guide member 140. The voltage of −300 V was applied to the intermediate guide member 130.

Third Example

The third example employed the electrification adjustment apparatus 30A (each of the electrification adjusters 27, 28 was the scorotron electrifier) as shown in FIG. 7. The PET layer with thickness of 100 μm functioning as the insulation layer 142 was formed on the surface of the second guide member 140.

Fourth Example

The fourth example employed the electrification adjustment apparatus 30C (each of the electrification adjusters 27, 28 is the scorotron electrifier) as shown in FIG. 9. The PET layer (insulation layer) with thickness of 100 μm was formed as the second guide 162 of the guide member 160 in the region covered by the second electrification adjuster 28.

First Comparative Example

The first comparative example employed the structure derived from removing the intermediate guide member 130 from the electrification adjustment apparatus 30 as shown in FIG. 2 (each of the electrification adjusters 27, 28 was the scorotron electrifier). The PET layer with thickness of 100 μm functioning as the insulation layer 142 was formed on the surface of the second guide member 140.

Second Comparative Example

The second comparative example employed the electrification adjustment apparatus 30 (each of the electrification adjusters 27, 28 was the scorotron electrifier) as shown in FIG. 2. The second electrification adjuster 28 was disposed on the first guide member 120 instead of the second guide member 140. The PET layer with thickness of 100 μm functioning as the insulation layer 142 was formed on the surface of the second guide member 140.

Evaluations have been made using the recording material made of the PET with thickness of 12 μm (hereinafter referred to as "PET recording material") as the recording material 20 to be subjected to the electrification adjustment. The electrification adjustment was made (target: 0 V) for the respective structures under conditions where the voltage with negative polarity (−7 kV) was applied to the corona discharge electrode 27*a* of the first electrification adjuster 27, the grid voltage was set to −50 V, −100 V, and −150 V, the voltage with positive polarity (7 kV) was applied to the corona discharge electrode 28*a* of the second electrification adjuster 28, and the grid voltage was set to 0 V.

After the electrification adjustment, the toner for copy (negative electrification toner) was sprinkled over the PET recording material on the second guide member 140 so as to visualize the electrification non-uniformity. The PET recording material was patted to visually evaluate the toner adhesion state. In the case of no toner adhesion to the recording material, the mark "○" was recorded. In the case of slight toner adhesion to the recording material, the mark "Δ" was recorded. In the case of the toner adhesion to the recording material, the mark "x" was recorded. Confirmation whether or not the separation discharge has occurred was made based on the discharge sound.

Table 1 of FIG. 12 shows the respective measurement results derived from the first to the fourth examples, and the first and the second comparative examples. As Table 1 shows, in each case of the examples, at the low grid voltage of the first electrification adjuster 27 set to −50 V, the toner adhesion was observed as a result of failing to eliminate the electrification non-uniformity. In the case of the first comparative example, the discharge sound was confirmed, and the separation discharge occurred. At the grid voltage of the first electrification adjuster 27 set to −100 V, the toner adhesion was not observed in the first to the fourth examples, succeeding in elimination of the electrification non-uniformity. On the contrary, the toner adhesion was observed in the first and the second comparative examples. In the first comparative example, the discharge sound was also confirmed. Even in the case of the structure according to the first example, the discharge sound accompanied with the separation discharge was confirmed as a result of raising the grid voltage to −150 V, causing the toner adhesion. The discharge sound was not confirmed in the second to the fourth examples and the second comparative example.

Findings from the above-described results will be described as follows.

(1) The first electrification adjuster 27 is required to supply sufficient charges relative to the electrification non-uniformity on the recording material. That is, at the grid voltage of −50 V (charge density: about 110 $\mu C/m^2$) in the first to the fourth examples, the amount of supplied charges is insufficient.

(2) Continuous increase in the amount of charge supplied by the first electrification adjuster 27 caused the separation discharge in the first example. It is therefore necessary to employ the structure that prevents increase in the gap potential difference shown in FIG. 6 (for example, structures of FIGS. 7 to 9).

(3) In the second comparative example, the second electrification adjustment (charge supply by the second electrification adjuster 28) was performed on the first guide member 120 with large electrostatic capacity. If the electrostatic capacity is fluctuated as a result of the process for conveying the recording material to the second guide member 140, the electrification non-uniformity on the recording material will be increased.

From the above-described measurement results, it is confirmed that the respective examples according to the embodiments of the present invention are capable of eliminating the electrification non-uniformity on the recording material surface while suppressing the separation discharge between the guide member and the recording material.

It was verified that the ink-jet recording apparatus 200 shown in FIG. 10 employed as the image forming apparatus with the electrification adjustment apparatus according to the respective embodiments generated no image failure (hereinafter referred to as "image non-uniformity") owing to the electrification non-uniformity.

Fifth Example

The fifth example employed the electrification adjustment apparatus 30A (see FIG. 7) as the structure used for the third example. The PET layer with thickness of 100 μm functioning as the insulation layer 142 was formed on the surface of the second guide member 140. The grid voltage of the first electrification adjuster 27 was set to −300 V, and the grid voltage of the second electrification adjuster 28 was set to 0 V and −100 V.

Third Comparative Example

Likewise the second comparative example, the third comparative example employed the electrification adjustment apparatus 30 (see FIG. 2), and the second electrification adjuster 28 was disposed on the first guide member 120 instead of the second guide member 140. The PET layer with thickness of 100 μm functioning as the insulation layer 142 was formed on the surface of the second guide member 140. The grid voltage of the first electrification adjuster 27 was set to −300 V, and the grid voltage of the second electrification adjuster 28 was set to 0 V and −100 V.

The evaluation was made by using the OPP (oriented polypropylene) recording material with thickness of 30 μm as the recording material 20 so that the half-tone (isolate dot) image was output by the ink-jet recording apparatus. The uniformity of the output image was visually evaluated. In the case of the image with uniformity, the mark "○" was recorded. In the case of the image with non-uniformity, the mark "x" was recorded. The ink adhesion state to the ink-jet head 242 after outputting the image was observed. If the ink adhesion was hardly observed, the mark "○" was recorded. If the ink adhesion was slightly observed, the mark "Δ" was recorded. If more ink adhesion was observed, the mark "x" was recorded.

Table 2 of FIG. 13 shows measurement results derived from the fifth example and the third comparative example. As Table 2 shows, the fifth example provides the uniform image. Meanwhile, the image derived from the third comparative example exhibits non-uniformity and an irregular outline (recorded as "x", indicating lack of image uniformity). Observing the enlarged part of the image with non-uniformity and the outline as described above, disorder of the dot shape, that is, elliptical shape was confirmed.

The degree of stain of the ink-jet head 242 became the lowest when the grid voltage of the second electrification adjuster 28 according to the fifth example was set to −100 V. The above-described result is considered to be related to the appropriate value for the electric field between the ink-jet head 242 and the recording material. Meanwhile, in the third comparative example, the stain of the ink-jet head 242 was worsened when the grid voltage of the second electrification adjuster 28 was set to −100 V. The above-described result is considered to be attributable to inappropriate control of the electric field between the ink-jet head 242 and the recording material resulting from the second electrification adjustment performed on the first guide member 120 having the electrostatic capacity increased, and the image formation in the ink-jet process on the second guide member 140 having the electrostatic capacity decreased.

From the above-described measurement results, it is confirmed that the examples according to the embodiments of the present invention are capable of eliminating the image noise owing to the electrification non-uniformity on the recording material surface. In other words, the image quality may be improved by those examples according to the embodiments of the present invention.

Effects of Embodiments

According to the first to the fifth embodiments as described above, it is possible to sufficiently reduce not only the apparent non-uniformity of the electrified potential owing to the charge density non-uniformity on the recording material such as the resin film, but also the charge density non-uniformity. This makes it possible to suppress the unnecessary influence of the electric field owing to the electrification non-uniformity in the image forming process for adhesion of the pigment (ink or toner) to the recording material. For example, it is possible to appropriately control flying of the ink droplets by eliminating the electrification non-uniformity on the recording material, which may influence flying of ink droplets, and shape of the landed droplet in the ink-jet type image forming process. It is therefore possible to suppress the unnecessary influence of the electric field upon flying of the ink droplets, and to further suppress dot deformation as a result of electrostatic induction of the droplet landed on the recording material.

Sixth Embodiment

In most cases, the image forming apparatus of electrographic type has been employed for forming a toner image on the paper recording material (that is, a plain paper). However, the paper recording material with high resistance tends to be easily electrified likewise the resin recording material. Therefore, the electrification adjustment apparatus according to the respective embodiments may be applied to any other image forming apparatus such as electrographic type so that improvement in the image quality is expected by eliminating the image noise owing to the electrification non-uniformity on the recording material surface.

Structure of Electrographic Image Forming Apparatus

An explanation will be made with respect to a structure example of the electrographic image forming apparatus as the sixth embodiment, which is provided with the electrification adjustment apparatus according to the embodiments. In the present embodiment, the image forming apparatus with the electrification adjustment apparatus 30 (see FIG. 2) according to the first embodiment will be described as an example.

Figures 14, 15:
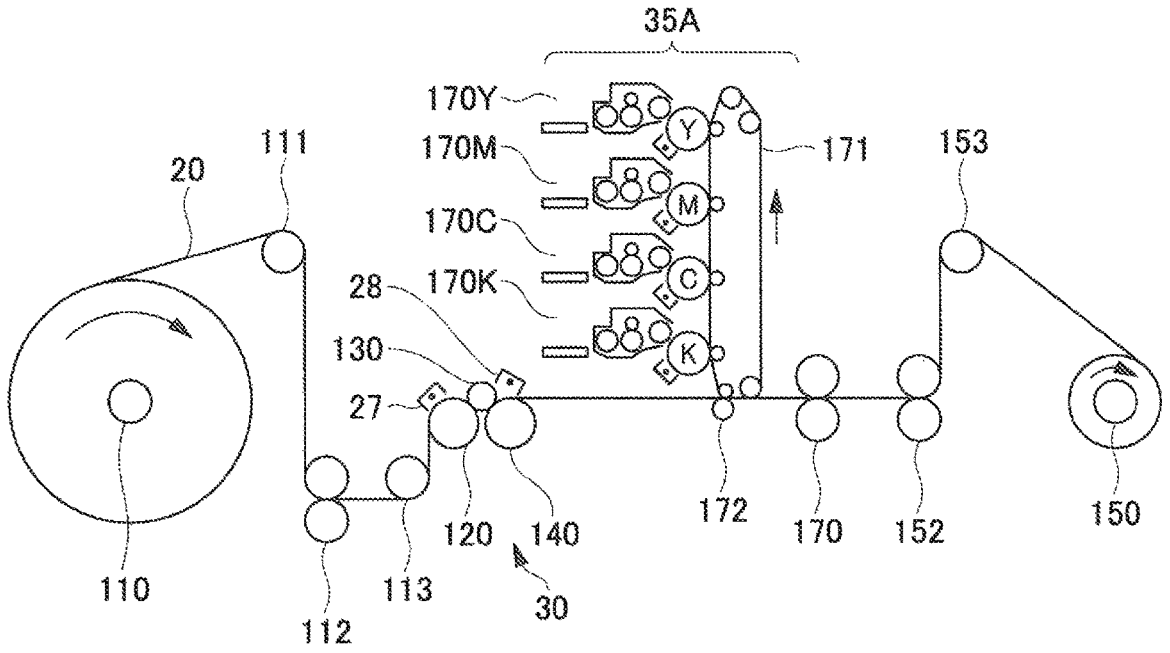
FIG. 14 is an explanatory view showing a structure example of an image forming apparatus with the electrification adjustment apparatus as shown in FIG. 2 according to a sixth embodiment of the present invention.
FIG. 15 is a table showing measurement results derived from the sixth example and the fourth comparative example.

FIG. 14 is an explanatory view showing a structure example of the image forming apparatus provided with the electrification adjustment apparatus 30 as shown in FIG. 2. An image forming apparatus 200A as shown in FIG. 14 is configured as the structure of the ink-jet recording apparatus 200 in which the ink-jet type image forming unit 35 provided with the head units 24 is replaced with an electrographic type image forming unit 35A.

The image forming unit 35A is disposed at the downstream side of the electrification adjustment apparatus 30, and provided with four image forming units 170Y, 170M, 170C, 170K corresponding to yellow (Y), magenta (M), cyan (C), black (K), respectively. The four image forming units 170Y to 170K are arranged sequentially in the order of yellow, magenta, cyan, and black from the upstream side with respect to the rotating direction of an intermediate transfer belt 171. The image forming unit 170Y is constituted by an electrification unit, an exposure unit, a development unit, and a photosensitive drum Y having a toner image developed on its surface. Each of the image forming units 170M to 170K is structured similarly to the image forming unit 170Y.

The toner images formed on the photosensitive drums by the respective image forming units 170Y to 170K based on the image data under the control of the control unit 40 are superposed through a primary transfer on the intermediate transfer belt 171 sequentially in accordance with the timing so that the color toner image (color image) is formed. The color image formed on the intermediate transfer belt 171 is subjected to a secondary transfer to the recording material 20 by a secondary transfer unit 172, and further subjected to the fixing process by a fixing unit 170.

Measurement Results

The electrographic image forming apparatus 200A as shown in FIG. 14 was employed as the image forming apparatus provided with the electrification adjustment apparatus according to the above-described embodiment so as to verify that no image failure owing to the electrification non-uniformity on the recording material surface occurred.

FIG. 15 is a table representing measurement results derived from a sixth example and a fourth comparative example.

Sixth Example

The sixth example employed the electrification adjustment apparatus 30A (see FIG. 7) with the structure according to the third example. The grid voltage of the first electrification adjuster 27 was set to −300 V, and the grid voltage of the second electrification adjuster 28 was set to 0 V.

Fourth Comparative Example

The fourth comparative example includes the electrification adjustment apparatus 30 (see FIG. 2) with the structure according to the second comparative example. The grid voltage of the first electrification adjuster 27 was set to −300 V, and the grid voltage of the second electrification adjuster was set to 0 V.

The evaluation was made using the OPP (oriented polypropylene) recording material with thickness of 30 μm as the recording material 20, and the image forming apparatus 200A for outputting a solid image by changing the output level of a secondary transfer voltage. The uniformity of the output image was visually evaluated. In the case of the image with uniformity, the mark "○" was recorded. In the case of the image with non-uniformity, the mark "x" was recorded. If the density of the solid image was sufficient, the mark "○" was recorded. If the density of the solid image was insufficient, the mark "x" was recorded.

Table 3 of FIG. 15 shows measurement results derived from the sixth example and the fourth comparative example. As Table 3 shows, the structure according to the sixth example provided the image with uniformity and sufficient density at the secondary transfer voltage of 1750 V. In spite of the region of the structure according to the fourth comparative example where the density was secured at the secondary transfer voltage of 1750 V, the image with non-uniformity and partially insufficient density was confirmed. Furthermore, the region with insufficient density was not corrected unless the secondary transfer voltage was increased to 2000 V. At the secondary transfer voltage lower than 2000 V, the structure failed to provide the image with uniformity. The above-described phenomenon is considered to be attributable to the difference in the transfer characteristic on the recording material surface with electrification non-uniformity between a non-electrified part and the electrified part.

In the case of using the negatively electrified toner, it is drawn to the positively electrified region of the recording material by not only the secondary transfer voltage but also the electrified recording material, resulting in the high toner transcription property. Meanwhile, in the negatively electrified part of the recording material, electrification of the recording material may serve to cancel the secondary transfer voltage, resulting in the low toner transcription property.

In the sixth embodiment, as the secondary transfer voltage becomes as high as 1750 V, the electrification non-uniformity on the recording material no longer exists (image uniformity "○"). Therefore, the secondary transfer characteristic hardly fluctuates depending on the location. The secondary transfer voltage to be applied may be arbitrarily set so long as the density is secured. In the fourth comparative example, the electrified state is variable depending on the position of the recording material. Even if the secondary transfer voltage is applied to the non-electrified part where the density may be secured, the negatively electrified part will act to cancel the secondary transfer voltage. This may fail to secure the density. As a result, it is necessary to apply the secondary transfer voltage which overtakes the canceling action of the transfer voltage in the negatively electrified part for the purpose of obtaining the uniform image.

If the secondary transfer voltage exceeds 2500 V, the secondary transfer unit 172 generates noise owing to discharge (Table 3 does not show the result). The need of setting the secondary transfer voltage to the high value for eliminating the electrification non-uniformity on the recording material may lead to the loss of the margin for setting the voltage.

The present invention is not limited to the above-described embodiments, but may be arbitrarily applied and modified in various forms so long as they do not deviate from the scope of the present invention.

For example, the embodiments have been described in detail for readily understanding of the present invention with respect to structures of the apparatus and the system, which are not necessarily limited to the one equipped with all components as described above. It is possible to replace a part of the structure of one embodiment with the component of another embodiment. The one embodiment may be provided with an additional component of another embodiment. It is further possible to add, remove, and replace the other component to, from and with a part of the structure of the respective embodiments.

It is also possible to implement the respective components, functions and processing units partially or entirely through hardware by designing integrated circuits, for example.

REFERENCE SIGNS LIST

20 recording material
27 first electrification adjuster
28 second electrification adjuster
30, 30A, 30B, 30C electrification adjustment apparatus
120 first guide member
121 metal roller
130 intermediate guide member
131 third DC power supply
140 second guide member
141 metal roller
142 insulation layer
160 guide member
161 first guide
162 second guide
200 ink-jet recording apparatus
201 image forming apparatus
271 first DC power supply
281 second DC power supply

What is claimed is:

1. An electrification adjustment apparatus comprising:

a conveyor member for conveying a recording material;

a first electrification adjuster disposed to face the recording material being conveyed, the first electrification adjuster supplying a charge with one polarity;

a second electrification adjuster disposed to face the recording material at a downstream side of the first electrification adjuster in a conveying direction, the second electrification adjuster supplying a charge with opposite polarity to the one polarity of the charge supplied by the first electrification adjuster;

a first DC power supply for a DC power supply to the first electrification adjuster; and a second DC power supply for a DC power supply to the second electrification adjuster, the second DC power supply having a polarity opposite to the polarity of the first DC power supply, wherein an electrostatic capacity between a surface of the recording material, which faces the second electrification adjuster and an electrode partially or entirely formed from the conveyor member is smaller than an electrostatic capacity between a surface of the recording material, which faces the first electrification adjuster and an electrode partially or entirely formed from the conveyor member, and any one of the surface and a back surface of the recording material is in contact with the conveyor member in a region between the first electrification adjuster and the second electrification adjuster.

2. The electrification adjustment apparatus according to claim 1, wherein:

the conveyor member includes a first guide member having a surface in contact with the recording material, a second guide member which is disposed at a downstream side of the first guide member in the conveying direction, and has a surface in contact with the recording material, and an intermediate guide member which is disposed in abutment with both the first guide member and the second guide member; and an electrostatic capacity on a surface of the second guide member is smaller than an electrostatic capacity on a surface of the first guide member.

3. The electrification adjustment apparatus according to claim 2, wherein the second electrification adjuster is disposed to face a nip part between the second guide member and the intermediate guide member.

4. The electrification adjustment apparatus according to claim 2, further comprising a third DC power supply for applying a voltage to the intermediate guide member, the voltage having the same polarity as the polarity of the charge supplied by the first electrification adjuster.

5. The electrification adjustment apparatus according to claim 1, wherein:

the conveyor member is structured to allow a first guide which faces the first electrification adjuster, and has a surface in contact with the recording material, and a second guide which faces the second electrification adjuster, and has a surface in contact with the recording material to be formed contiguous to each other; and an electrostatic capacity of the second guide is smaller than an electrostatic capacity of the first guide.

6. The electrification adjustment apparatus according to claim 2, wherein:

each of the first guide member, the second guide member, and the intermediate guide member has a conductive roller; and an insulation layer is coated on a circumferential surface of the roller of the second guide member.

7. The electrification adjustment apparatus according to claim 1, wherein:

each of the first electrification adjuster and the second electrification adjuster includes a discharge electrode, and a grid electrode disposed between the discharge electrode and the recording material; and a charge amount to be supplied to the recording material is adjusted in accordance with a voltage applied to the grid electrode.

8. An image forming apparatus comprising:

an electrification adjustment apparatus for executing an electrification adjustment to a recording material to be conveyed; and an image forming unit for forming an image on the recording material which has been subjected to the electrification adjustment, wherein:

the electrification adjustment apparatus includes a conveyor member for conveying a recording material, a first electrification adjuster disposed to face the recording material being conveyed, the first electrification adjuster supplying a charge with one polarity, a second electrification adjuster disposed to face the recording material at a downstream side of the first electrification adjuster in a conveying direction, the second electrification adjuster supplying a charge with opposite polarity to the polarity of the charge supplied by the first electrification adjuster, a first DC power supply for a DC power supply to the first electrification adjuster, and a second DC power supply for a DC power supply to the second electrification adjuster, the second DC power supply having a polarity opposite to the polarity of the first DC power supply; and an electrostatic capacity between a surface of the recording material, which faces the second electrification adjuster and an electrode partially or entirely formed from the conveyor member is smaller than an electrostatic capacity between a surface of the recording material, which faces the first electrification adjuster and an electrode partially or entirely formed from the conveyor member, and any one of the surface and a back surface of the recording material is in contact with the conveyor member in a region between the first electrification adjuster and the second electrification adjuster.

* * * * *